US006007359A

United States Patent [19]

Kosmala

[11] Patent Number: 6,007,359

[45] Date of Patent: Dec. 28, 1999

[54] RECEPTACLE CONNECTOR

[75] Inventor: Michael Lawrence Kosmala, Aliso Viejo, Calif.

[73] Assignee: ITT Manufacturing Enterprises, Inc., Wilmington, Del.

[21] Appl. No.: 08/977,602

[22] Filed: Nov. 25, 1997

[51] Int. Cl.[6] ..... H01R 13/62

[52] U.S. Cl. ..... 439/329; 439/607

[58] Field of Search ..... 439/92, 95, 101, 439/108, 259, 260, 329, 607

[56] References Cited

U.S. PATENT DOCUMENTS

| | | | |
|---|---|---|---|
| 3,436,715 | 4/1969 | Matthews . | |
| 3,629,787 | 12/1971 | Wilson . | |
| 3,744,009 | 7/1973 | Teagno et al. . | |
| 4,169,641 | 10/1979 | Olsson . | |
| 4,181,386 | 1/1980 | Olsson | 359/17 |
| 4,252,392 | 2/1981 | Whiteman, Jr. . | |
| 4,634,195 | 1/1987 | Shoemaker . | |
| 4,768,971 | 9/1988 | Simpson | 439/329 |
| 5,009,607 | 4/1991 | Gordon et al. | 439/67 |
| 5,102,342 | 4/1992 | Marian | 439/65 |
| 5,383,788 | 1/1995 | Spencer | 439/67 |
| 5,403,202 | 4/1995 | Roehling | 439/493 |
| 5,718,605 | 2/1998 | Morikawa | 439/607 |
| 5,807,126 | 9/1998 | Bethurum . | |

*Primary Examiner*—Khiem Nguyen
*Attorney, Agent, or Firm*—Thomas L. Peterson

[57] ABSTRACT

A receptacle connector (12) is provided for mounting on a circuit board (14) and for receiving a plug (30) to deflect the plug contacts (32) against contact pads (20) on the board, wherein a receptacle connector of simple design provides EMI (electromagnetic interference) shielding, means for fixing itself to the board in a simple and accurate manner, and means for secure plug latching. The receptacle connector includes a die cast metal housing and a plastic molded cam wall (26) fixed to the housing. The housing has three solder pad projections (100, 102, 104) at its bottom which are soldered to ground traces (110, 112, 114) on the circuit board to hold the housing in place and with its horizontal plane accurately parallel to the plane of the circuit board. The metal of the die cast housing provides EMI shielding and provides metal strikes (54) against which plug latches (50) are latched.

13 Claims, 3 Drawing Sheets

RECEPTACLE CONNECTOR

BACKGROUND OF THE INVENTION

One type of receptacle connector of applicant is mounted on an edge portion of a circuit board and forms a forwardly-opening space for receiving a plug. The circuit board has a row of contact pads, and the receptacle connector has a cam lying over the contact pads. When a plug is inserted, the cam wall deflects the plug contacts against the contact pads. In addition to the function of downwardly deflecting the plug contacts, the receptacle connector should accurately position the connector plug so all of its contacts properly engage corresponding contact pads, some EMI (electromagnetic interference) shielding is provided, and the plug is securely retained against accidental pullout. Previously, the receptacle connector was formed as an injection molded part of an insulative polymer, with sheet metal clips provided at opposite sides for soldering the part to the circuit board, and with a separate metal shield provided where EMI shielding was desired. This required the use of several parts, and even then the plastic molded connector did not provide as reliable long term latching to a plug as is required for some applications. A receptacle connector of the type generally described above, which could be constructed and mounted at low cost, would be of value.

SUMMARY OF THE INVENTION

In accordance with one embodiment of the present invention, a receptacle connector is provided and the combination of the receptacle connector and a circuit board are provided for receiving a plug, wherein the receptacle connector is constructed for efficient, low cost and accurate construction and mounting. The receptacle connector includes an electrically-conductive cast metal housing and a dielectric cam wall mounted on the housing. The receptacle connector is mounted on a circuit board with the cam wall lying over a row of contact pads on the board, so when a plug is inserted the cam wall deflects plug contacts against the contact pads. The metal housing can be mounted on the circuit board by laying the housing so solder pad projections that extend down from three locations about the housing, lie against solder pads on the circuit board and can be soldered thereto. The circuit board solder pads can be electrically grounded to ground the metal housing.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
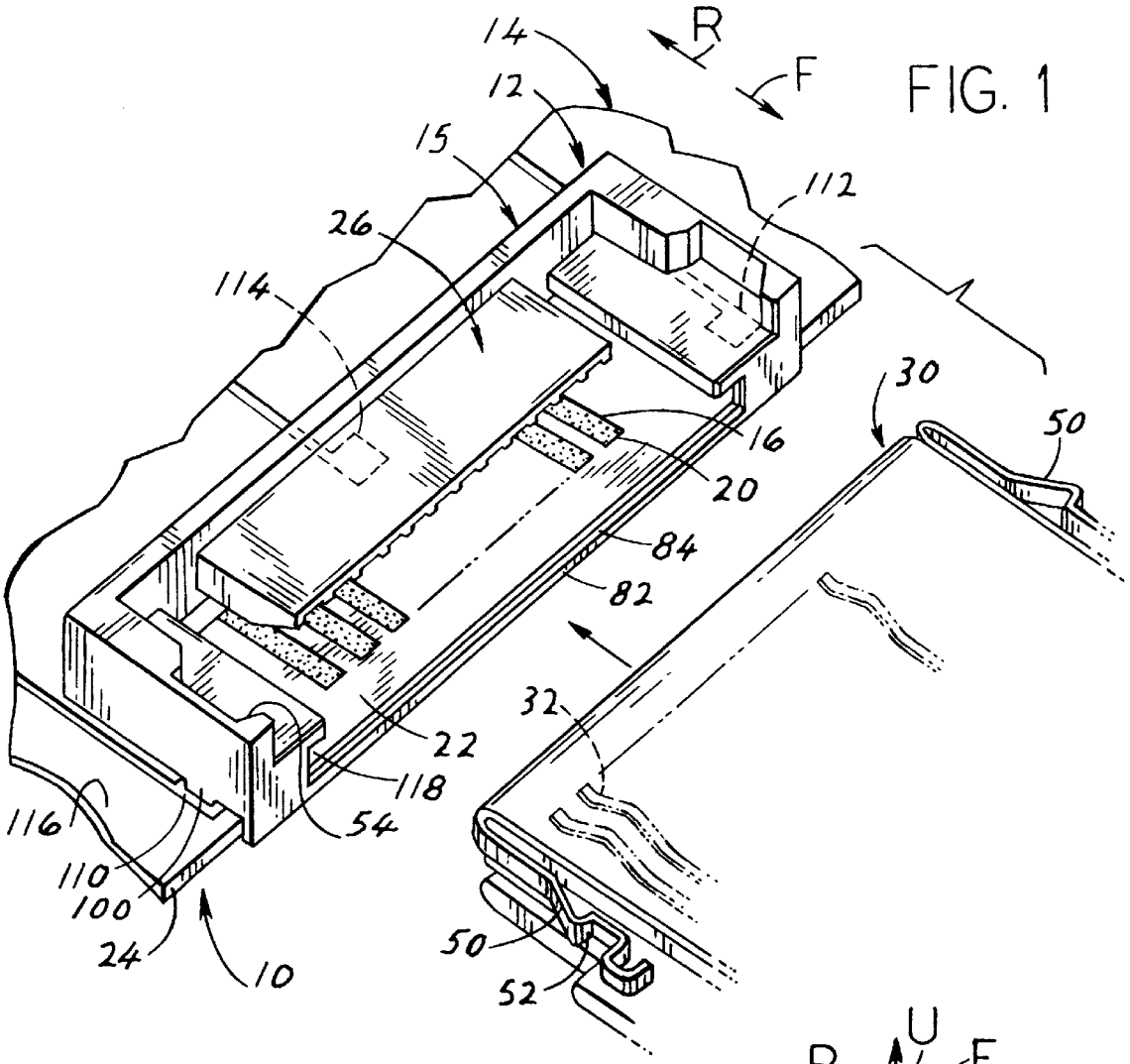
FIG. 1 is a top and front exploded isometric view, showing a receptacle connector assembly and showing a portion of a plug that can be mated thereto.
Figure 2:
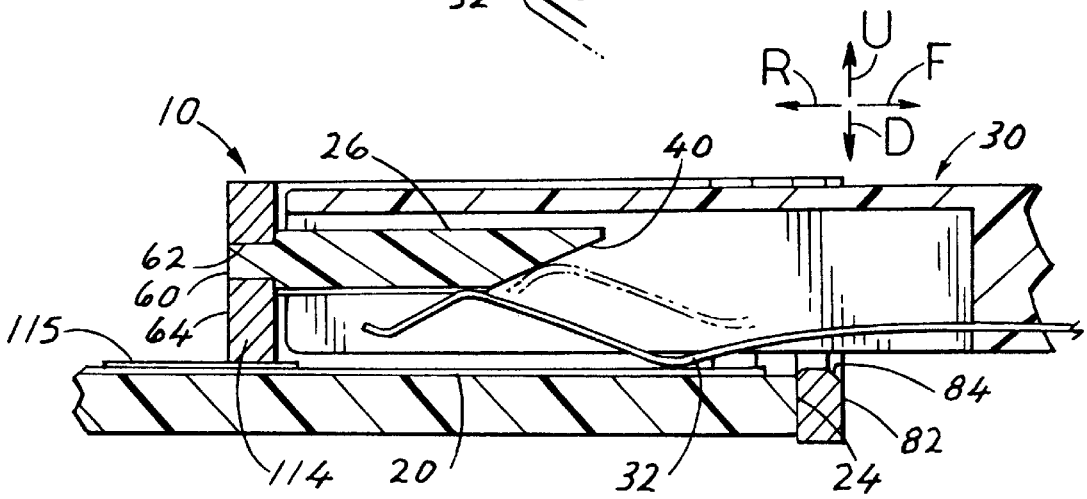
FIG. 2 is a sectional side view of the assembly of FIG. 1, showing the plug fully mated with the receptacle connector assembly.

FIG. 1 illustrates a receptacle connector assembly 10 that includes a receptacle connector 12 and a circuit board 14. The circuit board holds a row 16 of contact pads 20 in a board surface region 22 that lies adjacent to a board front edge 24, with the receptacle connector 12 mounted in that region. The receptacle connector includes a cam wall 26 that lies directly over the contact pads 20 but that is vertically spaced from them. A plug connector 30 includes a row of contacts 32 that are intended to engage the contact pads 20 when the plug is mated with the receptacle connector assembly. FIG. 2 shows the plug 30 fully mated with the receptacle connector assembly 10, with the plug contacts 32 engaged with the contact pads 20. In the course of mating, the contacts engage a cam surface 40 with a forward portion that extends at a rearward-downward (R, D) incline and a rearward portion that extends substantially horizontally. As shown in FIG. 1, the plug connector has latches 50 at its opposite sides, with largely forwardly-facing surfaces 52 that engage strikes with largely rearwardly facing walls 54 on the receptacle connector, to latch the plug assembly in place.

The cam wall 26, or at least its lower surface, is constructed of insulative, or dielectric material such as a typical engineering plastic, to avoid connecting the different plug contacts 32 together when depressing them against the contact pads. Previously, applicant molded the cam wall 26 integrally with the housing 15, of a dielectric polymer to provide a one-piece receptacle connector. However, to provide surface mounting on the circuit board, sheet metal clips were attached to the connector to enable a buyer of the connector to easily solder it to circuit board traces. Where EMI (electromagnetic interference) shielding was required, an additional sheet metal shield had to be mounted on the plastic molded connector. Furthermore, there was a question about the long term reliability of the strikes 54 which were repeatedly stressed during insertion and removal of the plug.

Figure 3:
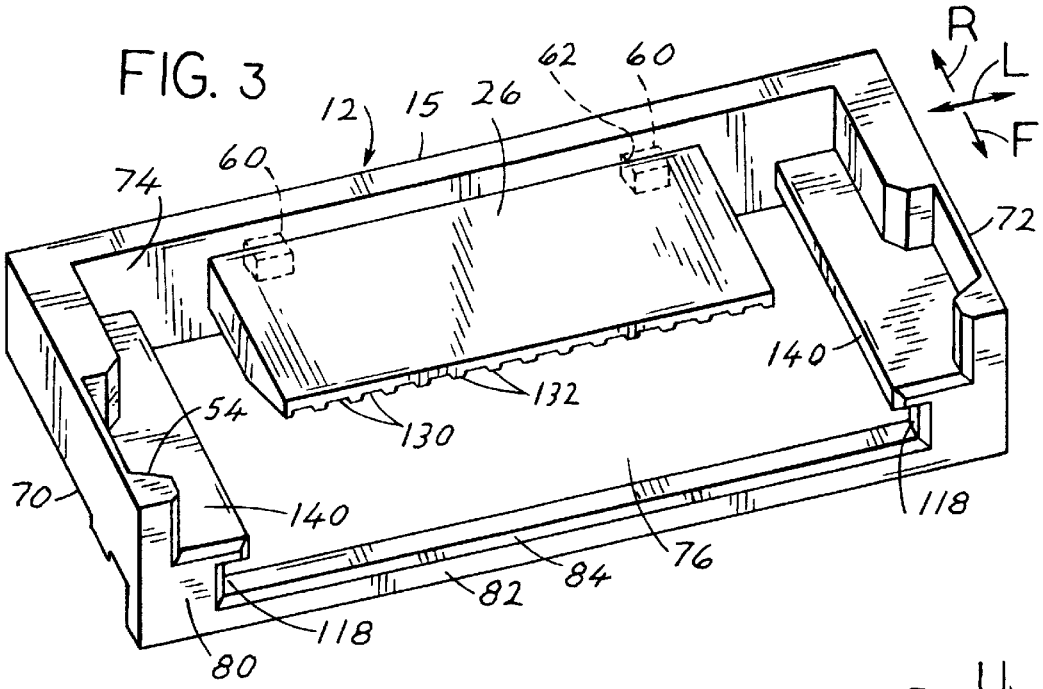
FIG. 3 is a top and front isometric view of the receptacle connector of the assembly of FIG. 2.

In accordance with the present invention, applicant constructs the receptacle connector 12 of FIG. 3 by constructing the housing 15 as a one-piece component of electrically conductive material, as by molding, or casting it of metal (e.g. of zinc and tin or nickel plated). The cam wall 26 is separately formed by molding it of a dielectric polymer such as an engineering plastic. The two parts 15, 26 are joined by providing one or more rear projections 60 in the cam wall 26 that project into one or more corresponding holes 62 formed in the cast metal housing 15. The rearward projection 60 can be fixed in place by inwardly deforming regions 64 of the metal against the projection 60, or other means such as adhesive or a very tight initial interference fit.

As shown in FIG. 3, the cast metal housing 15 has a pair of side walls 70, 72 and a rear wall 74 to form a generally forwardly-opening space 76. The front wall 80 includes a strip 82 that lies against the forward board edge 24 to cover it and form a tapered lead-in 84 for guiding the inserted plug. The forward wall also forms strikes with largely rearwardly facing walls 54 for the plug latches. The presence of metal on opposite sides of the space and rearward of it, by the presence of the walls 70, 72, 74, helps provide EMI shielding ESD (electrostatic discharge) protection, and cross-talk minimization. It is noted that it is possible to provide a ground plane in the middle or lower surface of the circuit board and that the upper wall of a plug may be provided with a metal plate to provide other shielding closely around the forward ends of the plug contacts.

Figure 4:
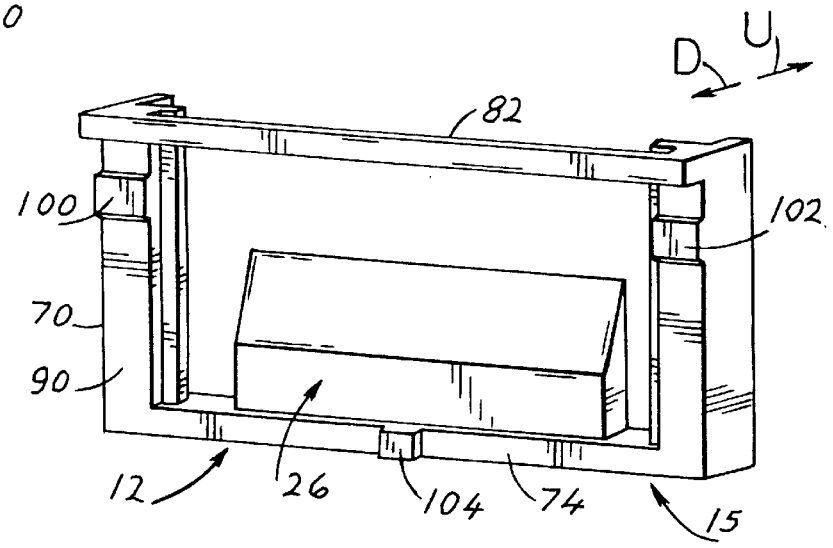
FIG. 4 is a bottom isometric view of the receptacle connector of FIG. 3.
Figure 5:
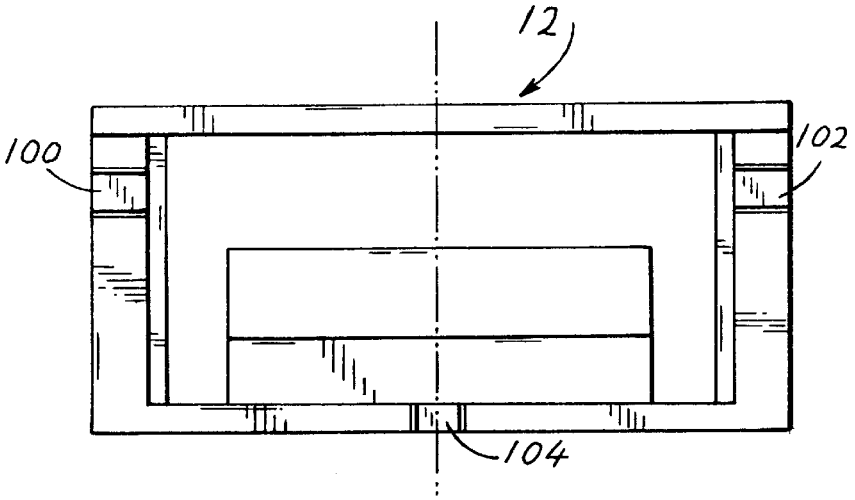
FIG. 5 is a bottom view of the receptacle connector of FIG. 4.
Figure 6:
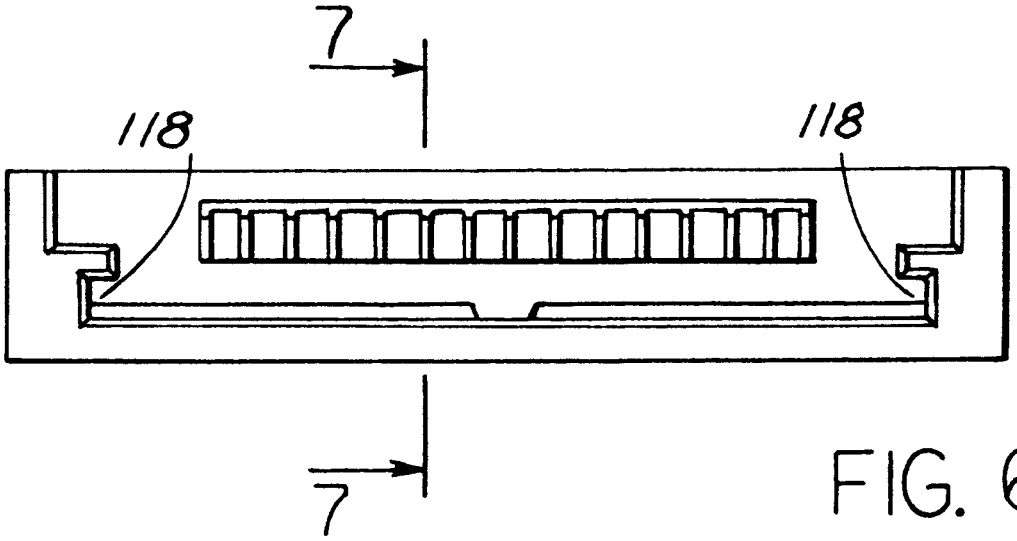
FIG. 6 is a front elevation view of the receptacle connector of FIG. 3.
Figure 7:
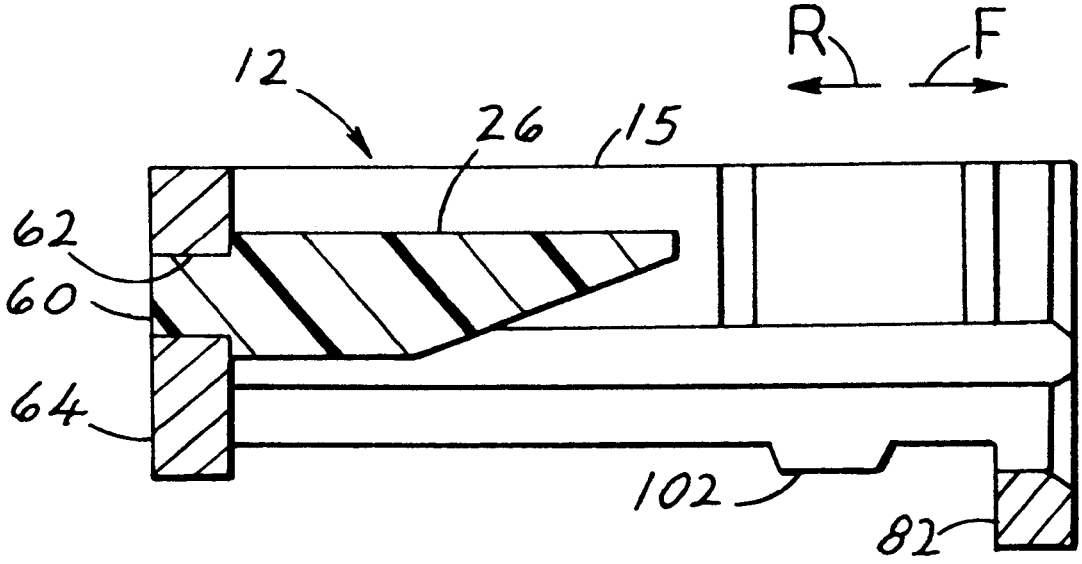
FIG. 7 is a sectional view taken on line 7—7 of FIG. 6.

FIG. 4 shows that the housing 15 has a bottom 90 at the side and rear walls 70, 72, 74. Solder pad projections 100, 102, 104 project downwardly from the rest of the housing except for the front strip 82, so the housing can rest on the circuit board by the projections 100–104 resting on the circuit board. It is noted that three solder pads define a plane, and therefore all of the three are assured of resting on the same plane and therefore of resting on the planar upper face of the circuit board. FIG. 1 shows that the circuit board has traces or pads 110, 112, 114 that are engaged by the solder pad projections such as 100 and that are soldered thereto. This arrangement has the advantage that separate metal clips are not required to be attached to the housing in order to surface solder it to traces on the circuit board. In addition, this construction results in the orientation of the housing 15 and the rest of the receptacle connector 12 being accurately established with respect to the plane of the upper face 116 of the circuit board. That is, the housing 15 is laid against the upper face of the circuit board at only three locations, so the orientation of the housing is accurately established with respect to the circuit board upper face. Of course, in manufacturer and/or testing, the lower surfaces of the three projections 100–104 are accurately established with respect to the positions of the rest of the housing, such as slots 118 at either side of the front of the housing which closely receive a lower portion of the plug to accurately position the plug. Applicant prefers to connect the pads 110–114 of the circuit board to a constant potential, which may be referred to as a ground potential, which avoids having the housing pick up or radiate signals passing along the plug contacts. It may be noted that in FIG. 2, an insulative strip 115 is placed over the contact pads 20, except at the solder pad projection 114, to isolate the metal housing from the circuit board traces.

In a receptacle connector 12 of the construction shown in FIG. 3, the connector had an overall width in the lateral direction L of 27.0 mm, a length in the directions F, R of 11.3 mm and a height (except at the strip 82) of 3.82 mm. The cam wall 26 had a maximum thickness of 1.04 mm. The cam wall formed fourteen recesses 130 between corresponding separators 132, with the surfaces at the recesses 130 directly engaging the plug contacts to depress them. The separators help assure alignment of all contacts with corresponding recesses and therefore traces on the circuit board. It is noted that the receptacle connector has a pair of holdown walls 140 that holdown the plug after it has been inserted through the end slots 110.

It would be possible to mold the electrically conductive housing of an electrically conductive polymer, but this would not provide highly wear resistant strike. Also, solderability to a circuit board would require a metal coating or attachment.

Although terms such as "up", "down" etc. are used to help describe the connector, it can be used in any orientation with respect to the Earth.

Thus, the invention provides a receptacle connector comprising an electrically conductive housing and a dielectric cam wall, and provides a receptacle connector assembly that includes the connector and a circuit board on which it lies, wherein the receptacle connector is constructed for simple manufacture and mounting and provides good EMI shielding and wear resistant latch strikes. The connector is formed by a metal housing with opposite side walls and a rear wall that form a forwardly-opening space for receiving a plug, and by a dielectric cam wall. The connector is designed to mount on a circuit board with the cam wall lying over a row of contact pads on the board, to depress plug contacts against the contact pads. The metal housing can have three solder pad projections at its bottom for lying on corresponding traces or pads on the circuit board to solder thereto, with the circuit board pads preferably at a constant potential, referred to as a ground. The above construction results in the ability to rapidly surface mount the connector on a circuit board without requiring separate clips, assures accurate three-point mounting of the connector on the board, provides EMI shielding, and provides wear resistant latch strike surfaces.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A receptacle connector which is designed to be mounted on a circuit board over a row of contact pads on the circuit board and to form a forwardly-opening plug receiving space in cooperation with said board, with said space designed to receive a plug connector that has a row of contacts that are intended to engage said row of contact pads, wherein:

said receptacle connector includes a housing with walls that at least partially surround said space and a cam wall with a camming surface spaced from said circuit board to directly engage said contacts and deflect them against said contact pads;

said housing is formed of electrically conductive material, said walls of said housing form at least one mount hole, and said cam wall is formed of dielectric material and has at least one projection that projects into said mount hole and is rigidly fixed to the walls of said mount hole to thereby fix said cam wall to said housing so they form an integral part that can be handled as a single piece.

2. The receptacle connector described in claim 1 wherein:

said housing is an integral cast metal member.

3. The receptacle connector described in claim 1 wherein:

said housing has a vertical rear wall with said at least one mount hole in it, and said cam wall projection is a rearward projection that lies in and is trapped in said mount hole.

4. A combination of a circuit board and a receptacle connector, for receiving a plug that has deflectable contacts and a pair of latches, wherein:

said circuit board has a forward board edge and has a surface region adjacent to said board edge, with said surface region having a row of traces forming contact pads;

said receptacle connector includes a one-piece metal housing mounted on said board, said housing have opposite side walls lying on opposite sides of said row of contact pads, and a rear wall spaced rearwardly of said board edge and extending between said side walls, with said side and rear walls and said circuit board forming a forwardly-opening space for receiving said plug;

said receptacle connector also includes a cam wall of dielectric material mounted on said housing and lying directly over said row of contact pads, said cam wall having cam surfaces for downwardly deflecting the plug contacts against said contact pads as the plug is inserted into said space;

said housing side walls forming metal strikes with largely rearwardly-facing walls for engaging said latches.

5. The combination described in claim 4 wherein:

said one-piece molded housing is molded with at least one mount hole in said rear wall, and said cam wall has a rearward projection that projects rearwardly into said mount hole and that is fixedly captured therein.

6. The combination described in claim 4 wherein:

said housing in an integral cast metal member.

7. A method for constructing a receptacle for a plug that has electrical contacts, comprising:

forming, in a mold, a metal housing which has a rear wall and opposite side walls, with said walls having bottoms constructed to mount on a circuit board;

forming a dielectric cam wall with an inclined lower surface portion, and fixedly mounting said cam wall on said housing so said cam wall lies between said side walls and is spaced above said circuit board.

8. A receptacle connector which is designed to be mounted on a circuit board over a row of contact pads and to form a forwardly-opening plug receiving space in cooperation with said board, with said space designed to receive a plug connector that has a row of contacts that are intended to engage said row of contact pads, wherein:

said receptacle connector includes a housing with walls that at least partially surround said space including opposite side walls and a rear wall and a cam wall positioned to directly engage said contacts and deflect them against said contact pads;

said housing is formed of electrically conductive material, and said cam wall is formed of dielectric material and is fixed to said housing;

said housing has a bottom extending along said side walls and rear wall, with said bottom having a plurality of downward solder pad projections including at least one at each of said side walls and at said rear wall for lying on said circuit board.

9. The receptacle connector described in claim 8 wherein:

said plurality of solder pad projections consists of three, with one at the bottom of each of said side and rear walls.

10. The receptacle connector described in claim 8 including said circuit board, and wherein:

said circuit board has a plurality of ground pads, and each of said projections lies against and is soldered to one of said ground pads.

11. A combination of a circuit board and a receptacle connector, for receiving a plug that has deflectable contacts, wherein:

said circuit board has a forward board edge and has a surface region adjacent to said board edge, with said surface region having a row of traces forming contact pads;

said receptacle connector includes a one-piece electrically conductive housing mounted on said board, said housing have opposite side walls lying on opposite sides of said row of contact pads, a rear wall spaced rearwardly of said board edge and extending between said side walls and a front wall strip that lies directly in front of said board edge, with said side and rear walls and said circuit board forming a forwardly-opening space for receiving said plug;

a cam wall of dielectric material mounted on said housing and lying directly over said row of contact pads, said cam wall having cam surfaces for downwardly deflecting the plug contacts against said contact pads as the plug is inserted into said space;

said housing has a bottom and has a plurality of integral downwardly-projecting pads at said bottom;

said circuit board has a plurality of ground pads, with said projections lying on said ground pads and soldered thereto.

12. A method for constructing a receptacle for a plug that has electrical contacts, comprising:

forming, in a mold, a metal housing which has a rear wall and opposite side walls, with said walls having bottoms constructed to mount on a circuit board and with said bottoms of said rear and side walls having downward projections;

forming a dielectric cam wall with an inclined lower surface portion, and fixedly mounting said cam wall on said housing;

forming a circuit board with an upper face and with electrically grounded ground pads and with a row of contact pads all on said board upper face;

positioning said housing so said projections lie against said ground pads and said cam wall lies spaced over said contact pads, and soldering said projections to said ground pads.

13. A combination of a circuit board, a receptacle connector, and a plug that has deflectable contacts, wherein:

said circuit board has a forward board edge and has a surface region adjacent to said board edge, with said surface region having a row of traces forming contact pads;

said receptacle connector includes a one-piece metal housing mounted on said board and a cam wall lying over said contact pads, said housing had laterally-spaced opposite side walls lying on opposite sides of said row of contact pads and a rear wall spaced rearwardly of said board edge and extending between said side walls, and said side and rear walls and said circuit board form a forwardly-opening space for receiving at least the contacts of said plug;

said cam wall is formed of dielectric material, said cam wall is mounted on said housing and said cam wall has cam surfaces for downwardly deflecting the plug contacts against said contact pads as the plug is inserted at least partially into said space;

said housing side walls are spaced apart and laterally locate said plug as said plug is inserted rearwardly into said fowardly-opening space;

said metal housing side walls have strikes with largely rearwardly-facing walls, and said plug has latches with largely forwardly-facing walls that engage said largely rearwardly-facing walls of said strikes when said plug is fully inserted into said forwardly-opening space.

* * * * *